US011254392B2

(12) United States Patent
Smith

(10) Patent No.: US 11,254,392 B2
(45) Date of Patent: Feb. 22, 2022

(54) MOORING APPARATUS

(71) Applicant: Flintstone Technology Ltd, Dundee (GB)

(72) Inventor: David Smith, Dundee (GB)

(73) Assignee: FLINTSTONE TECHNOLOGY LTD, Dundee (GB)

( * ) Notice: Subject to any disclaimer, the term of this patent is extended or adjusted under 35 U.S.C. 154(b) by 0 days.

(21) Appl. No.: 16/606,746

(22) PCT Filed: Apr. 26, 2018

(86) PCT No.: PCT/GB2018/051102
§ 371 (c)(1),
(2) Date: Oct. 19, 2019

(87) PCT Pub. No.: WO2018/197881
PCT Pub. Date: Nov. 1, 2018

(65) Prior Publication Data

US 2020/0094923 A1 Mar. 26, 2020

(30) Foreign Application Priority Data

Apr. 27, 2017 (GB) ..... 1706745
Jul. 24, 2017 (GB) ..... 1711907

(51) Int. Cl.
*B63B 21/50* (2006.01)
*B63B 21/04* (2006.01)
*E02B 3/24* (2006.01)

(52) U.S. Cl.
CPC ..... *B63B 21/50* (2013.01); *B63B 21/04* (2013.01); *E02B 3/24* (2013.01)

(58) Field of Classification Search
CPC ..... B63B 21/50; B63B 21/508; B63B 21/04; B63B 21/10; E02B 3/24
(Continued)

(56) References Cited

U.S. PATENT DOCUMENTS 4,193,368 A 3/1980 Degraaf et al.
5,293,831 A 3/1994 Whitehead
(Continued)

FOREIGN PATENT DOCUMENTS

GB 2512312 A 10/2014
GB 2527782 A 1/2016
(Continued)

OTHER PUBLICATIONS

International Preliminary Report on Patentability, International Application No. PCT/GB2018/051102, dated Oct. 29, 2019, 7 pp.
(Continued)

*Primary Examiner* — Daniel V Venne
(74) *Attorney, Agent, or Firm* — Myers Bigel, P.A.

(57) ABSTRACT

A mooring apparatus (10*a;* 10*b;* 10*c;* 10*d*) comprising a socket (15*a;* 15*b;* 15*c;* 15*d*), a connection member (20*a;* 20*b;* 20*c;* 20*d*), and an arrangement (25*a;* 25*b;* 25*c;* 25*d*) for positioning and/or controlling the disposition of the connection member (20*a;* 20*b;* 20*c;* 20*d*) relative to the socket (15*a;* 15*b;* 15*c;* 15*d*), the connection member (20*a;* 20*b;* 20*c;* 20*d*) being receivable and/or retainable in the socket (15*a;* 15*b;* 15*c;* 15*d*). A method of configuring a mooring apparatus (10*a;* 10*b;* 10*c;* 10*d*), wherein the method comprises providing the mooring apparatus (10*a;* 10*b;* 10*c;* 10*d*), the method further comprising connecting a first portion of a line (35) to a line engaging apparatus (30*a*) and positioning or extending the line (35) around the positioning arrangement (25*a;* 25*b;* 25*c;* 25*d*).

23 Claims, 11 Drawing Sheets

(58) Field of Classification Search
USPC ..... 114/230.2, 230.25, 230.26, 230.28, 114/230.29, 230.3
See application file for complete search history.

(56) References Cited

U.S. PATENT DOCUMENTS

| | | | | |
|---|---|---|---|---|
| 5,364,075 | A | 11/1994 | Montgomery | |
| 8,397,655 | B2 * | 3/2013 | Braud | B63B 21/508 114/230.12 |
| 10,005,522 | B2 * | 6/2018 | Taylor | B63B 21/50 |
| 10,035,568 | B2 * | 7/2018 | Taylor | B63B 21/50 |
| 10,377,448 | B2 * | 8/2019 | Smith | B63B 21/508 |

FOREIGN PATENT DOCUMENTS

| | | | |
|---|---|---|---|
| WO | 2009/141351 | A2 | 11/2009 |
| WO | 2013/186553 | A1 | 12/2013 |
| WO | 2016/118006 | A1 | 7/2016 |

OTHER PUBLICATIONS

International Search Report and Written Opinion of the International Searching Authority, International Application No. PCT/GB2018/051102, dated Jul. 27, 2018, 10 pp.
"Communication pursuant to Article 94(3) EPC", EP Application No. 18728692.7, dated Mar. 24, 2021, 7 pp.

* cited by examiner

MOORING APPARATUS

RELATED APPLICATIONS

This application is a 35 U.S.C. § 371 national stage application of PCT Application No. PCT/GB2018/051102, filed on Apr. 26, 2018, which itself claims priority from Great Britain Patent Application No. 1711907.4, filed on Jul. 24, 2017, and Great Britain Patent Application No. 1706745.5, filed on Apr. 27, 2017, the contents of all of which are incorporated herein by reference in their entireties. The above-referenced PCT International Application was published in the English language as International Publication No. WO 2018/197881 A1 on Nov. 1, 2018.

FIELD OF INVENTION

This invention relates to an apparatus for connecting a mooring line, a system for connecting a mooring line, and a method of use of the apparatus or system for connecting a mooring line. The mooring line may be a mooring line for a vessel, an offshore structure, floating structure, an anchor, buoy or the like.

BACKGROUND TO INVENTION

Offshore structures, such as floating structures or platforms, may be moored by mooring lines, such as mooring chains. A tension may be applied to each of the mooring lines, for example, by the use of a tensioning apparatus. The application of tension may serve to moor the floating structure or platform in a desired position.

A mooring apparatus may require assembly before a tension is applied to the mooring line. Assembly may include direct or indirect connection of at least one mooring line to the structure to be moored and direct, or indirect, coupling of each mooring line to another structure, such as an anchor or pile located on the seabed.

The mooring lines, and in particular the ends of the mooring lines, may comprise chains. A connection between a vessel, anchor, or the like, to a chain which may, in use, be under tension, may be prone to stress and wear.

In an offshore environment, because of a relative movement between a vessel, a mooring line and an anchoring point, there may be a degree of movement at a connection between the mooring line and the vessel and/or anchoring point. Such movement may further stress and wear the mooring line and connection components. The relative movement may cause Out of Plane Bending (OPB) fatigue, which may exacerbate the wear of the mooring components.

The use of structures such as lever arms and fairleads, to minimise the effects of OPB, is known. However, such structures may be large, heavy, expensive and difficult to install, operate and/or maintain.

Further, the installation and maintenance of such structures in an offshore or underwater environment may require high levels of skill, the use of divers, operators, and/or underwater Remotely Operated underwater Vehicles (ROVs), and may incur significant expense and risk.

It is an object of at least one embodiment of at least one aspect of the present invention to obviate or at least mitigate one or more problems in the prior art.

It is an object of at least one embodiment of at least one aspect of the present invention to provide a technically simple and/or commercially more cost effective method and apparatus for mooring than in the prior art.

SUMMARY OF INVENTION

According to a first aspect of the present invention there is provided a mooring apparatus. The mooring apparatus may comprise a socket. The mooring apparatus may comprise a connection member. The mooring apparatus may comprise a positioning arrangement for positioning and/or controlling the disposition of the connection member relative to the socket. The connection member may be receivable and/or retainable in the socket.

The Applicant calls this apparatus a "Pull-In Uni-Joint".

The socket may comprise at least one seat, and optionally at least a portion of the at least one seat may be substantially U-shaped, hook-shaped or J-shaped.

The connection member may be adapted to rotate on the at least one seat around a first axis defined by the pair of trunnions.

The connection member may comprise a joint defining a second axis about which at least a portion of the connection member may be adapted to rotate. At least a portion of the connection member may be adapted to rotate around the first axis and/or the second axis.

The positioning arrangement may comprise a guide such as a sheave or a chain wheel, and optionally which a line extends around. The positioning arrangement may comprise a line engaging apparatus disposed on and/or connected to the connection member.

In use, the line may extend from the connection member and/or the line engaging apparatus around the guide.

The seat, or a base of the seat, or receiving portion or weight-bearing portion of the seat, may face toward, or may be oriented in the direction of, the guide.

The connection member may be for connecting, such as disconnectably connecting, to a mooring line. The connection member may be provided with an arrangement for connecting, such as disconnectably connecting, the apparatus to a mooring line.

Preferably the connection member may be removably retainable in the socket.

Preferably the connection member may be removably receivable in the socket.

Preferably the connection member may comprise a line engaging apparatus. In use, a first portion of a line may be connected to the line engaging apparatus.

The positioning arrangement may comprise the line.

The positioning arrangement may comprise a guide. The guide may be a sheave or a wheel, such as a chain wheel. The guide may be a pulley, or a component of a pulley mechanism. In use, the line may extend from the connection member around the guide.

The socket may comprise at least one seat. The at least one seat may be substantially hook-shaped.

A distal end of the connection member may be adapted for connecting the apparatus to a mooring line. In use, which may include positioning of the connection member, the mooring line may be under tension.

The line engaging apparatus may be positioned at a proximal end of the connection member.

The line may be a wire, a rope, or a a chain. In use, the line may extend around and/or about and/or through the positioning arrangement.

The socket may comprise at least one guide portion.

In use, a pulling force on a second portion of the line, the pulling force being in a direction away from the guide, may pull the first portion of the line towards the guide.

The pulling force may pull the connection member towards and/or into the socket and/or onto a guide portion.

In use, a reduction in the pulling force on a second portion of the line, the pulling force being in a direction away from the guide, may move the connection member into the seat. The connection member may move towards the seat under the force of gravity and/or under a force induced by a tension, such as a mooring tension in the mooring line. The connection member may move towards the seat along the guide portion.

The pulling force may pull the connection member towards and/or out of the socket and/or along a guide portion and/or away from a guide portion. In use, a reduction in the pulling force on a second portion of the line, the pulling force being in a direction away from the guide, coupled with a further pulling force applied to the connection member, may move the connection member out of the socket and/or in a direction away from the socket.

The further pulling force may be applied by a support line, a lifting wire, a lifting line, or a bridle.

The connection member may comprise a lever arm.

The pair of trunnions may be adapted to fit and/or sit in the at least one seat. The pair of trunnions may be retained by the at least one seat.

The apparatus may comprise a retaining pin. The retaining pin may be adapted to restrict movement of the connection member when the connection member is positioned on the at least one seat.

Each connection member may comprise at least one retaining member.

The connection member and/or the retaining member may comprise at least one shoulder or wing. The connection member or the retaining member may comprise a pair of shoulders or wings. The at least one shoulder or wing may be adapted to move around and/or rotate around or about an outer surface of the seat. The connection member may be adapted to be located in a retained position within and/or by the or each socket. In the retained position, the seat may be located between the pair of trunnions and the at least one shoulder or wing.

The apparatus may be adapted for connection to, or mounting on or in, a structure. The structure may be a floating structure, or a vessel. The structure may be an anchor, a pile, such as a suction pile, or gravity anchor.

In use, such as during installation and/or stowage and/or removal, replacement or maintenance of the apparatus, the at least a portion of the connection member may be at least partially submerged.

In use, such as during installation and/or stowage and/or removal, replacement or maintenance of the apparatus, the apparatus, or at least a portion of the apparatus, may be completely above a water line, completely below the water line, or at least partially submerged.

Advantageously, the apparatus described above does not require implementation of a load bearing pin. Instead, in the present invention, a load is carried by the at least one seat. Having a connection that does not require a load bearing pin is advantageous for high load mooring lines as the Minimum Breaking Load (MBL) directly relates to the load pin size. Very large and heavy load pins add more risk and potentially more cost to the installation.

Advantageously, minimal connection member retaining features are required, since the connection member is subject only to a small degree of over rotation during installation, resulting in a lighter, smaller and cheaper apparatus.

Advantageously, the apparatus described above enables a fully assembled mooring line to be pulled into a socket while the mooring line is under tension. As such, the apparatus may be used with or without a mooring line tensioner in the system.

According to a second aspect of the present invention there is provided a method of configuring a mooring apparatus, wherein the method comprises:

providing a mooring apparatus according to the first aspect of the present invention, the method further comprising:

connecting a first portion of a line to a line engaging apparatus; and positioning or extending the line around the positioning arrangement.

The positioning arrangement may comprise a guide.

To retain the connection member in the socket, the method may comprise applying a pulling force on a second portion of the line, the pulling force being in a direction away from the guide, such that the first portion of the line moves towards the guide.

To retain the connection member in the socket, the method may comprise reducing a pulling force on a second portion of the line, the pulling force being in a direction away from the guide, such that the connection member moves into the seat.

To remove the connection member from the socket, the method may comprise the step of applying a pulling force to the second portion of the line, the pulling force being in a direction away from the guide, such that the first portion of the line moves towards the guide.

To remove the connection member from the socket, the method may comprise the step of reducing a reducing a pulling force on a second portion of the line, the pulling force being in a direction away from the guide, coupled with applying a further pulling force to the connection member in a direction away from the socket.

According to a third aspect of the present invention there is provided a mooring system, the mooring system comprising the mooring apparatus according to the first aspect of the present invention.

The system may comprise a plurality of mooring apparatuses according to the first aspect of the present invention.

The system may comprise a mooring line. At least a portion of the mooring line may comprise a chain.

The system may comprise a support line. At least a portion of the support line may comprise a chain.

The system may comprise a structure. The structure may be a subsea structure, such as an anchor, a suction pile, or a gravity anchor. The structure may be located on or near to a seabed The structure may comprise at least one socket.

The mooring line may be connected to the connection member. The mooring line may be connected to a distal end of the connection member.

The support line may be connected to the connection member. The support line may be connected to a distal end of the connection member.

Advantageously, the apparatus, system and/or method described herein may permit the mooring line to be pre-cut to size and installed without a tensioning device on such, since the mooring line can be pulled in at a tension above the nominal/design tension of the mooring line to a "pulled in" position and then lowered down to the seat to achieve a design tension.

It should be understood that the features defined above in accordance with any aspect of the present invention or below relating to any specific embodiment of the invention may be utilised, either alone or in combination with any other defined feature, in any other aspect or embodiment or to form a further aspect or embodiment of the invention.

BRIEF DESCRIPTION OF DRAWINGS

These and other aspects of the present invention will now be described, by way of example only, with reference to the accompanying drawings, which are.

DETAILED DESCRIPTION OF DRAWINGS

Figure 1:
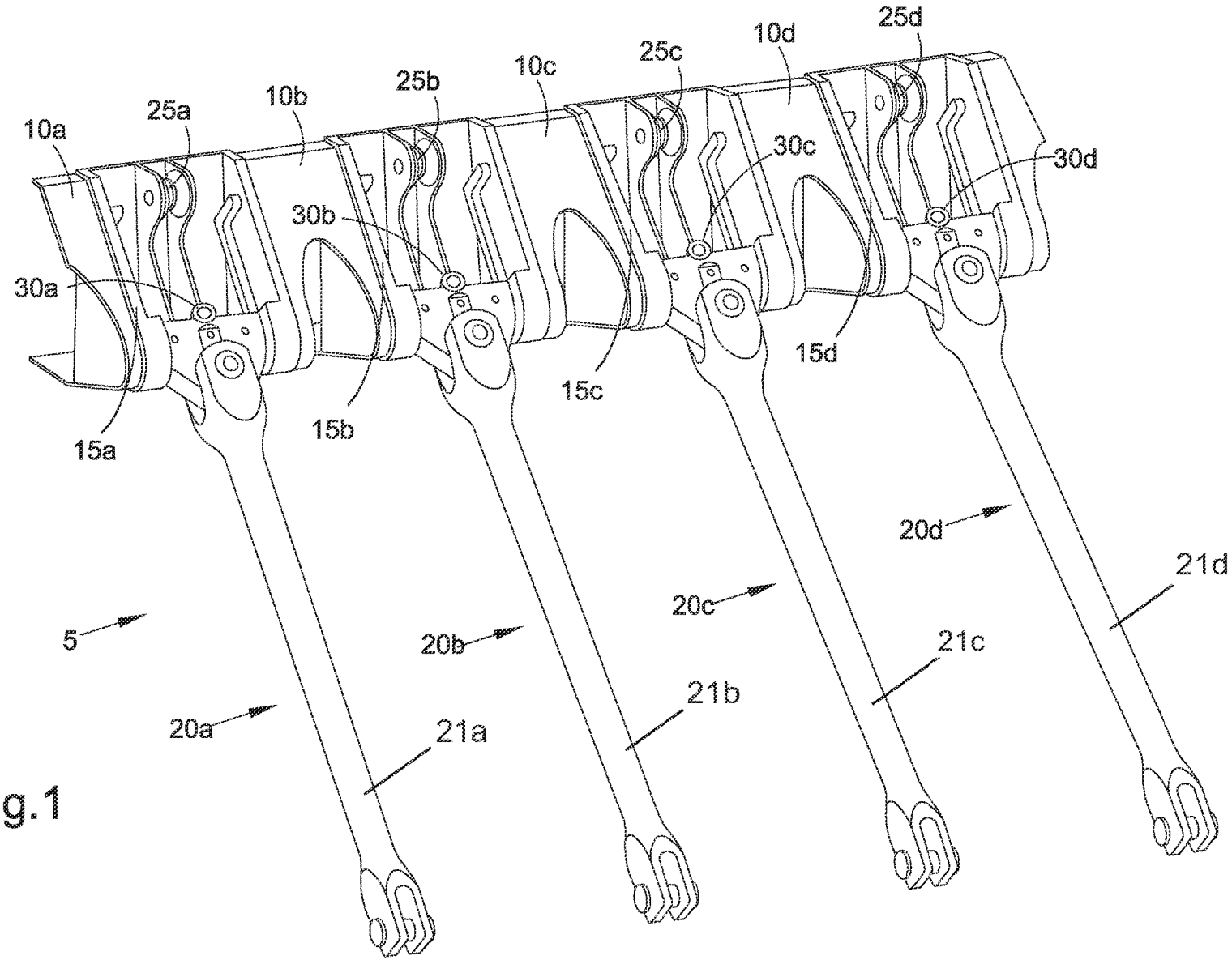
FIG. 1 a perspective view of a plurality of mooring apparatuses according to a first embodiment of the present invention.

Referring firstly to FIG. 1, there is shown a perspective view of a plurality of mooring apparatuses, generally denoted 5, according to a first embodiment of the present invention. In the exemplary embodiment shown there is shown four mooring apparatuses 10*a*; 10*b*; 10*c*; 10*d*. One will appreciate that the embodiment of FIG. 1 is for illustrative purposes and that there may, in use, be fewer mooring apparatuses, such as one, two or three mooring apparatuses, or a greater number of mooring apparatuses, such as five or more, without deviating from the inventive concept disclosed herein.

Each mooring apparatus 10*a*; 10*b*; 10*c*; 10*d* comprises a socket 15*a*; 15*b*; 15*c*; 15*d*, a connection member 20*a*; 20*b*; 20*c*; 20*d*, and a positioning arrangement 28 for positioning the connection member 20*a*; 20*b*; 20*c*; 20*d* relative to the socket 15*a*; 15*b*; 15*c*; 15*d*, the connection member 20*a*; 20*b*; 20*c*; 20*d* being retainable in the socket 15*a*; 15*b*; 15*c*; 15*d*. The connection member 20*a*; 20*b*; 20*c*; 20*d* is removably retainable in the socket 15*a*; 15*b*; 15*c*; 15*d*. The connection member 20*a*; 20*b*; 20*c*; 20*d* is removably receivable in the socket 15*a*; 15*b*; 15*c*; 15*d*.

The connection member 20*a*; 20*b*; 20*c*; 20*d* comprises a line engaging apparatus 30*a*; 30*b*; 30*c*; 30*d*. Each connection member 20*a*; 20*b*; 20*c*; 20*d* comprises a lever arm 21*a*, 21*b*, 21*c*.

Figure 2:
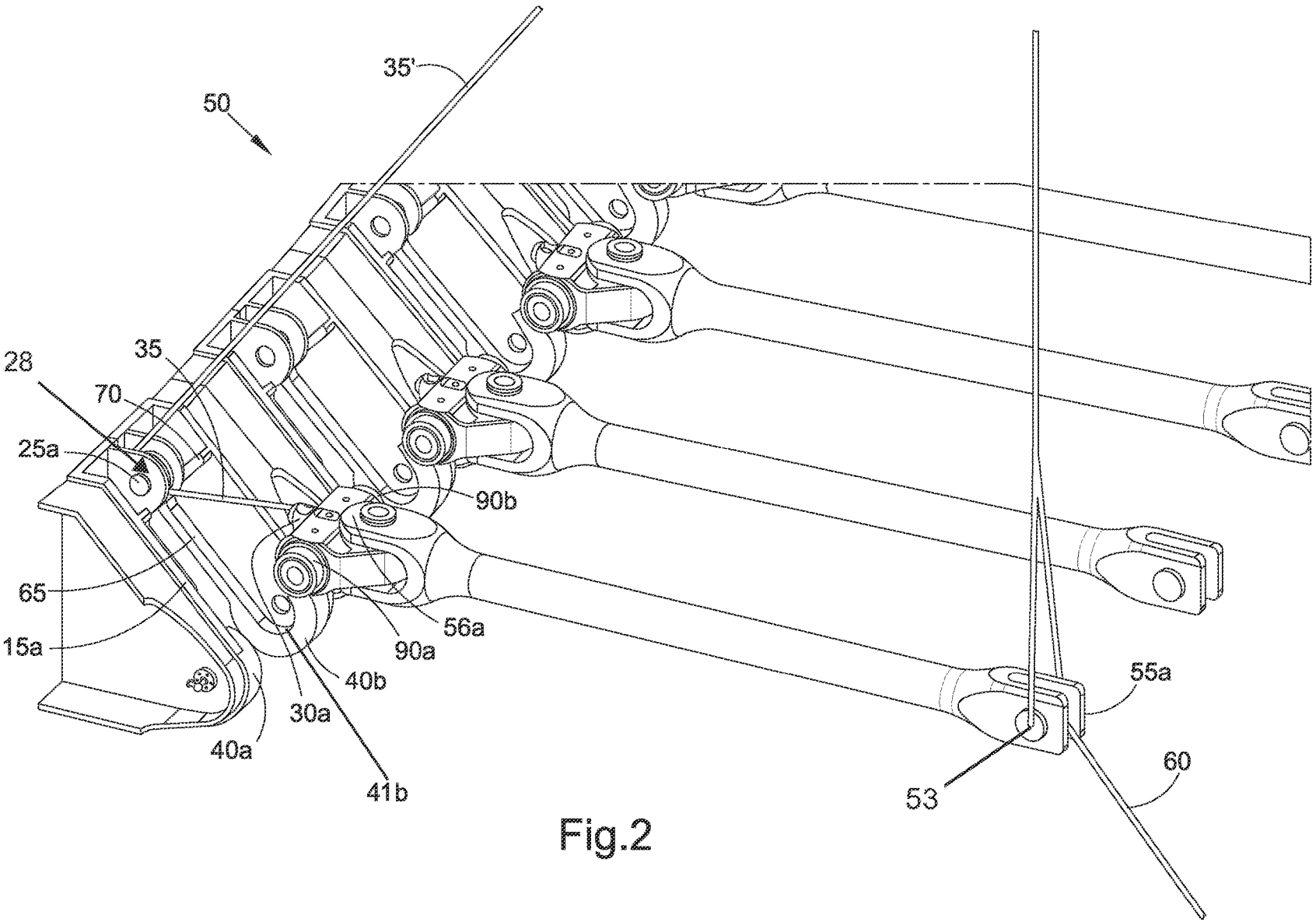
FIG. 2 a perspective view of a mooring system according to the first embodiment of the present invention.

FIG. 2 shows a further perspective view of a portion generally denoted 50, according to the first embodiment of the present invention comprising the plurality of mooring apparatuses. FIG. 2 shows four complete apparatuses 10*a*; 10*b*; 10*c*; 10*d*, wherein one of the apparatuses 10*a* is arranged as part of the system 50. One will appreciate that the embodiment of FIG. 2 is for illustrative purposes only and that there may, in use, be fewer mooring apparatuses, such as one, two or three mooring apparatuses, or a greater quantity of mooring apparatuses, such as five or more, and that any or all of the mooring apparatuses may be arranged as part of one or more mooring systems 50, without deviating from the inventive concept disclosed herein.

A first portion of a line 35 is connected to the line engaging apparatus 30*a*. The positioning arrangement 28 comprises a guide 25*a*. The guide 25*a* is a sheave. In other embodiments encompassing the inventive concept of the present invention, the guide 25*a* can be a wheel, such as a chain wheel, or the guide 25*a* can be a pulley, or a component of a pulley mechanism.

Each socket 15*a* comprises a pair of seats 40*a*, 40*b*. Each seat 40*a*, 40*b* is substantially hook-shaped. One will appreciate that in variations of a design that encompass the inventive concept of the present invention, each seat 40*a*, 40*b* can be substantially J-shaped, or "reverse-J" shaped, or cup-shaped. Each seat 40*a*, 40*b* is a boss or protuberance.

Each seat 40*a*, 40*b*, may at least partially or substantially face toward, or may be oriented in the direction of, the guide 25*a*. The connection member 20*a* is provided with an arrangement 53 for connecting the apparatus to a mooring line 60. A distal end 55*a* of the connection member 20*a* is adapted for connecting the apparatus 10*a* to the mooring line 60. In use, the mooring line 60 can be under tension, such as a mooring tension. Typically, at least a portion of the mooring line 60 comprises a chain.

A distal end 55*a* of the connection member 20*a* is adapted for connecting the apparatus 10*a* to a support line 80. In use, the support line 80 can position the connection member 20*a*, as will be described below. At least a portion of the support line 60 can comprise a chain.

The line engaging apparatus 30*a* is positioned at a proximal end 56*a* of the connection member 20*a*. The line 35, 35' can be a wire, a rope, a chain, or the like. In use, the line 35, 35' extends around and/or about and/or through the positioning arrangement 28.

The socket 15*a* comprises a guide portion 65. The guide portion 65 extends to a limiting portion 70. The limiting portion 70 limits a degree of movement of the connection member 20*a* within the socket 15*a*. The limiting portion 70 stops the connection member 20*a* interfering with the guide 25*a* during removal and/or installation of the connection member 20*a* within the socket 15*a*. The guide portion 65 is a boss or protuberance.

The connection member 20*a* comprises a pair of trunnions 90*a*, 90*b*. The pair of trunnions 90*a*, 90*b* are adapted to fit and/or sit in the pair of seats 40*a*, 40*b*. The pair of trunnions 90*a*, 90*b* are adapted to retained by the pair of seats 40*a*, 40*b*.

Figure 3A:
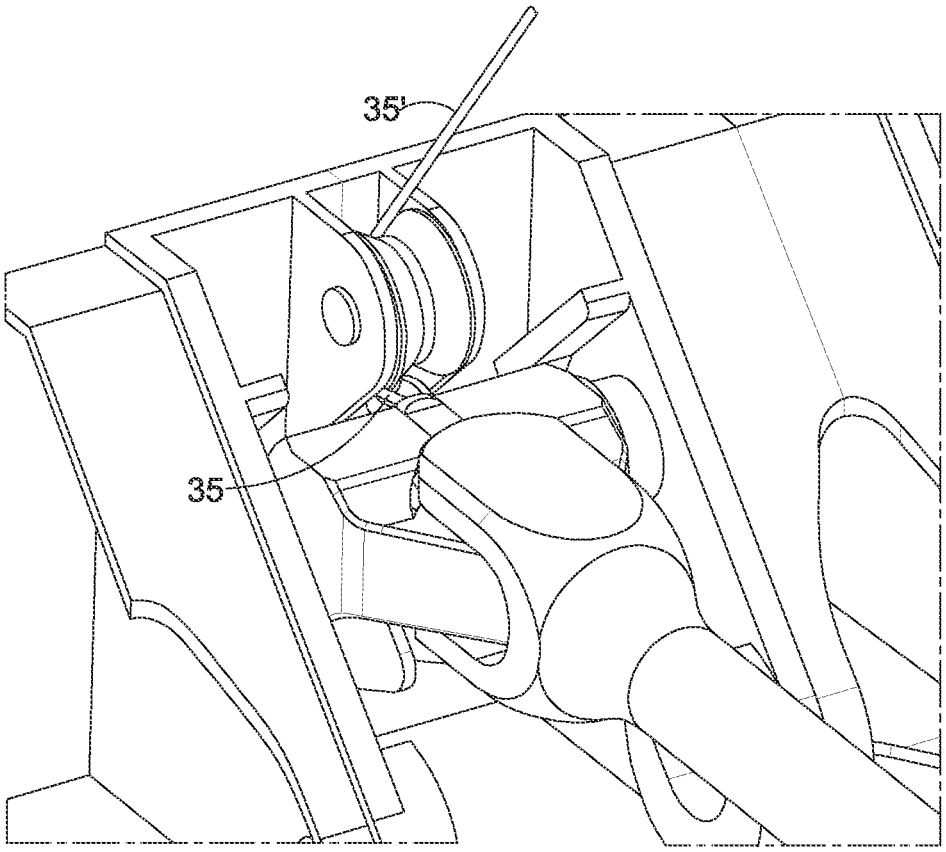
FIG. 3*a* a perspective view of a portion of the mooring system according to the first embodiment of the present invention.

Referring now to FIG. 3*a*, there is shown a perspective view of a portion of a mooring system 50, according to the first embodiment of the present invention. FIG. 3*a* shows the arrangement of FIG. 2, with the connection member 20*a* pulled in towards the socket 15*a*. In use, a pulling force is applied to a second portion 35' of the line 35, 35', the pulling force being in a direction away from the guide 25*a*. The pulling force pulls the first portion of the line 35 towards the guide 25*a*.

Figure 3B:
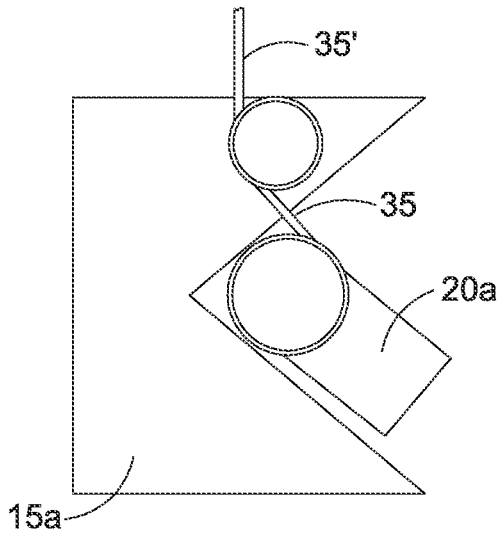
FIG. 3*b* a schematic representation of a cross-sectional view of the mooring system of FIG. 3*a;*

In use, the pulling force pulls the connection member 20*a* towards and into the socket 15*a* and onto the guide portion 65. FIG. 3*b* shows a representation of a cross-sectional view of the mooring system 50 of FIG. 3*a*, wherein the connection member 20*a* is shown positioned in the socket 15*a*.

Figure 4:
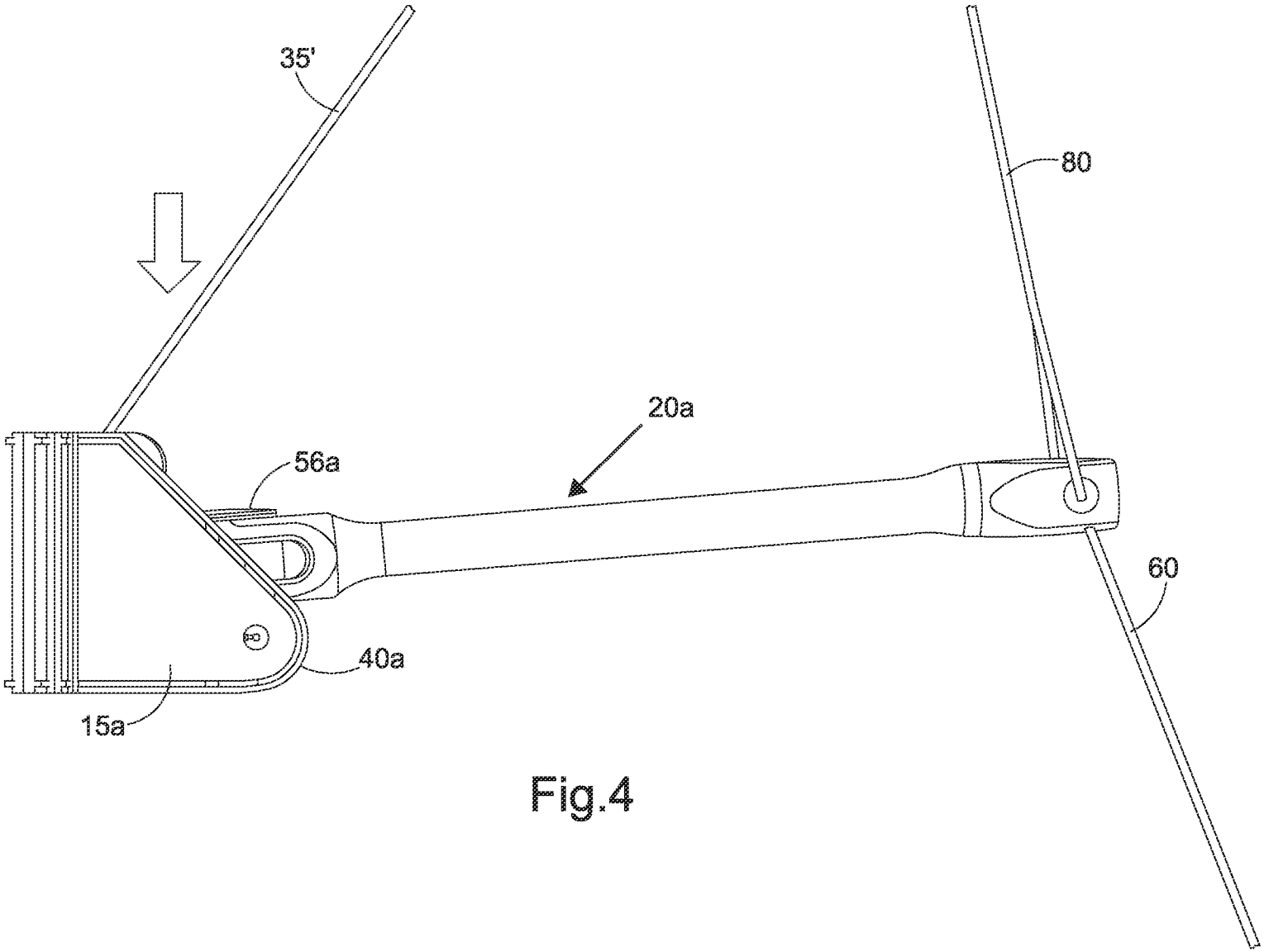
FIG. 4 a side view of the mooring system of FIG. 3*a;*

Referring now to FIG. 4, there is shown a side view of the mooring system of FIG. 3*a*. FIG. 4, where compared with FIG. 3*a*, shows that, in use, a reduction in the pulling force on the second portion 35' of the line 35, 35', the pulling force being in a direction away from the guide 25*a*, the connection member 20*a* moves towards the seat 40*a*. In the embodiment as shown in FIG. 4, the tension of the mooring line 60 is substantially taken by a support line 80. As such, the proximal end 56*a* of the connection member 20*a* can be lowered from the position shown in FIG. 3*a*, to the position shown in FIG. 4, and subsequently to the position shown in FIGS. 5*a* and 5*b*.

Figure 5A:
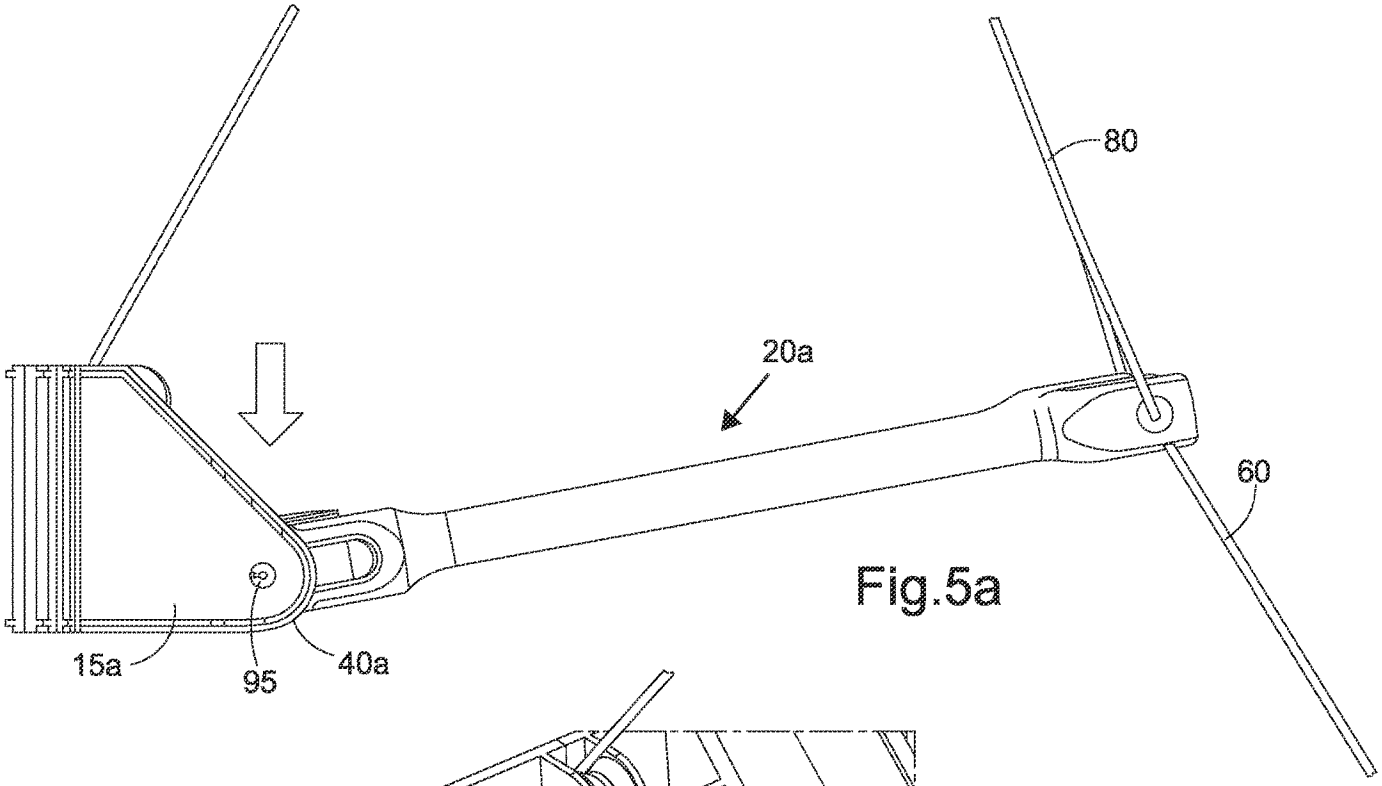
FIG. 5*a* a further side view of the mooring system of FIG. 3*a*, with the connection member in the retained position.
Figure 5B:
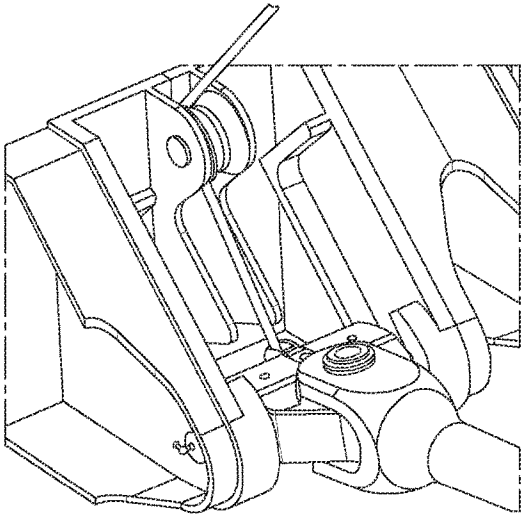
FIG. 5*b* a further perspective view of a portion of the mooring system of FIG. 5*a;*

Referring now to FIG. 5*a*, there is shown a further side view of the mooring system 50 of FIG. 3*a*, with the connection member 20*a* in a retained position. Due to the reduction in the pulling force on the second portion 35' of the line 35, 35', the pulling force being in a direction away from the guide 25*a*, the connection member 20*a* has moved into the pair of seats 40*a*, 40*b*. The connection member 20*a* can move towards the pair of seats 40*a*, 40*b* at least partly under the force of gravity and/or under a force induced by a tension, such as a mooring tension in the mooring line. The connection member 20*a* moves towards the pair of seats 40*a*, 40*b*, from the position shown in FIG. 3*a* to the position shown in FIG. 5*a*, along the guide portion 65.

The apparatus 10*a*; 10*b*; 10*c*; 10*d* can optionally comprise a retaining pin 95. The retaining pin 95 is adapted to restrict movement of the connection member 20*a* when the connection member 20*a* is positioned on the pair of seats 40*a*, 40*b*.

Figure 6:
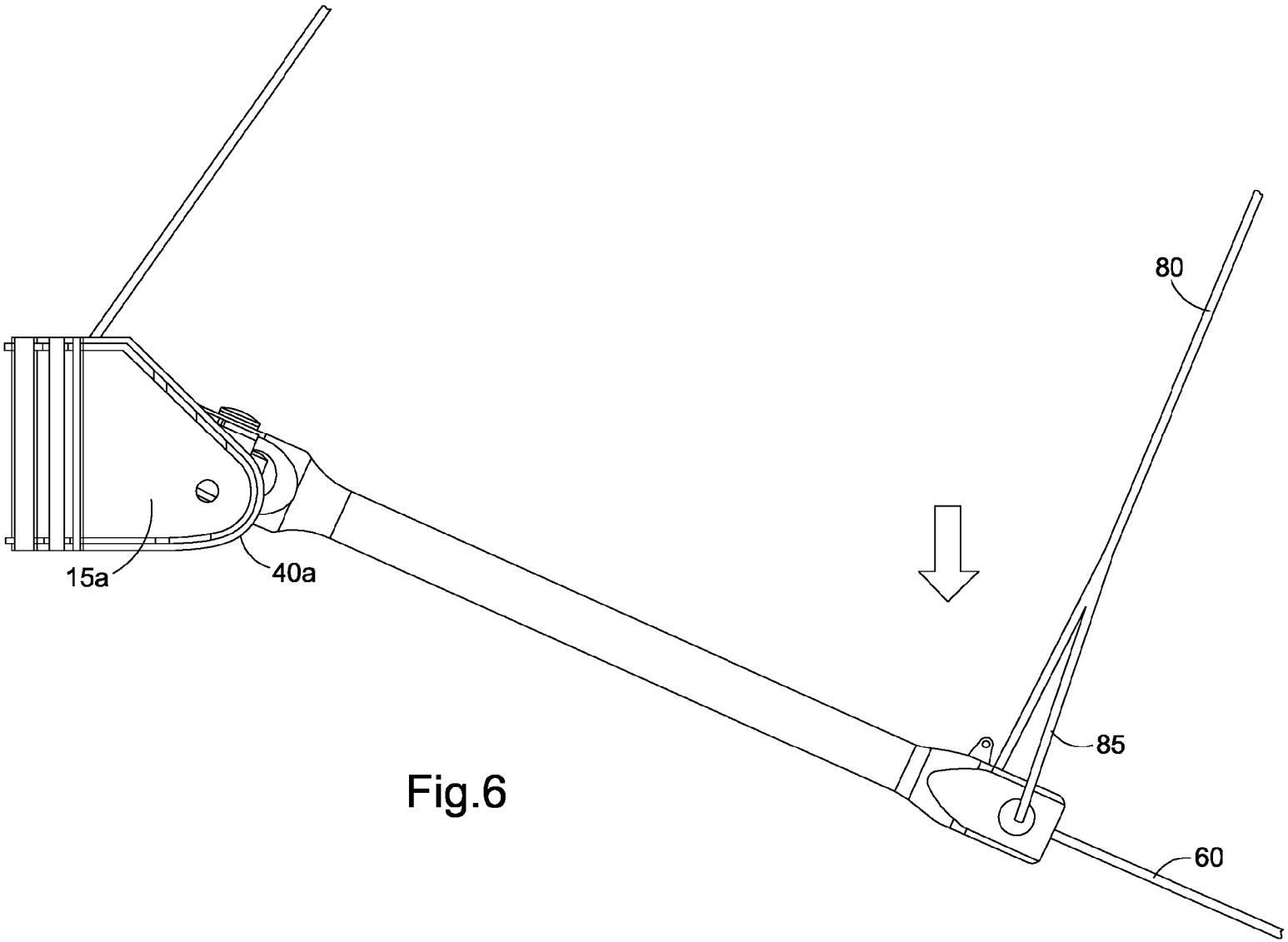
FIG. 6 a side view of the mooring system of FIG. 3*a*, with the connection member in a lowered position.
Figure 7:
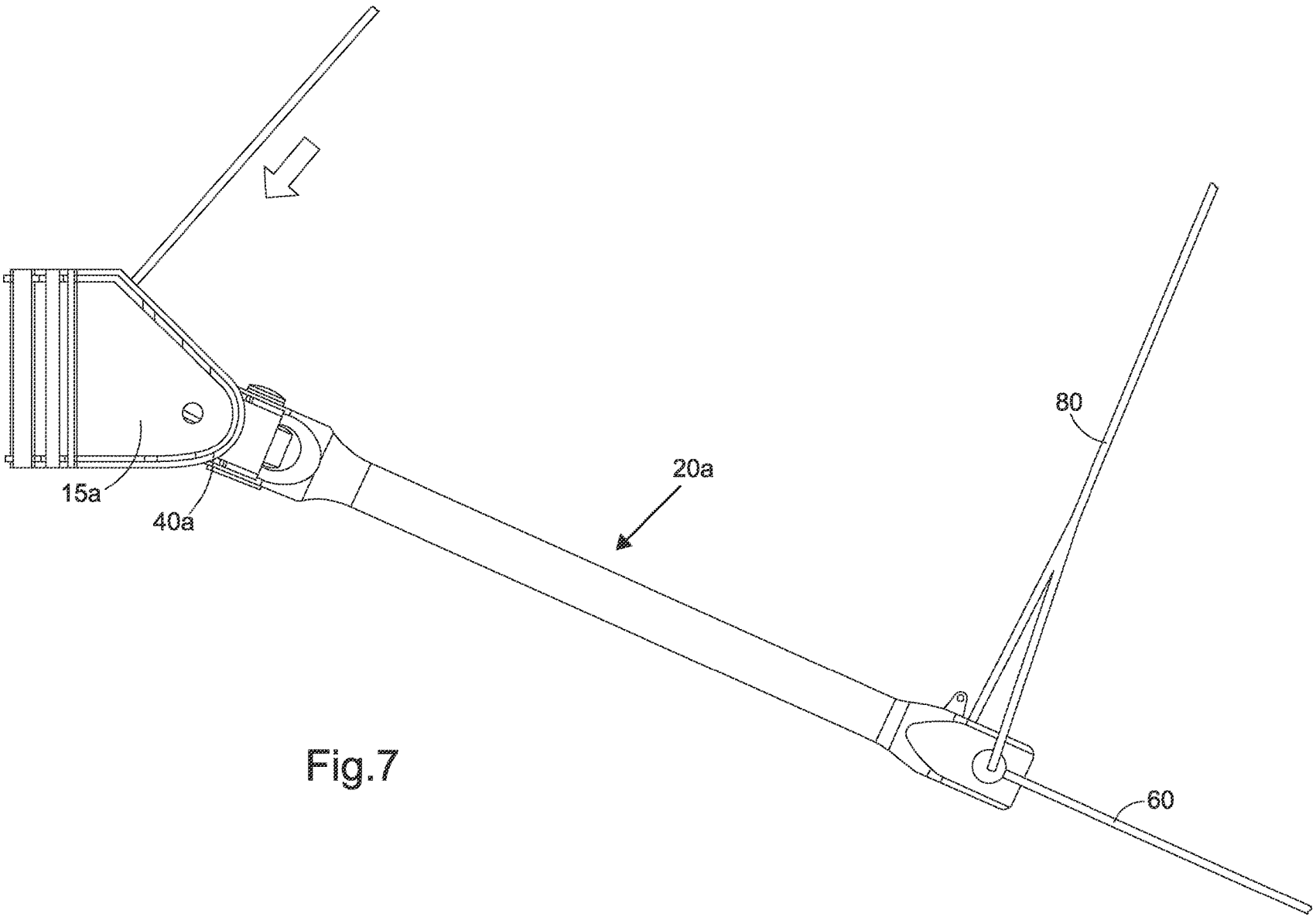
FIG. 7 a side view of the mooring system of FIG. 6, with the connection member in a retained position.

Referring now to FIG. 6, there is shown a side view of the mooring system 50 of FIG. 3*a*, with the connection member 20*a* in a lowered position. FIG. 6 shows an alternative method of installation to that of FIGS. 4 and 5*a*. In the embodiment of FIG. 6, the support line 80 has been lowered. The connection member 20*a* is substantially oriented in line with a straight portion of the guide portion 65. FIG. 7 shows a subsequent position of the connection member 20*a* relative to the socket 15*a* following a reduction in the pulling force on the second portion 35' of the line 35, 35'. In FIG. 7, the connection member 20*a* is in a retained position.

In order to remove a connection member 20*a* from a socket 15*a*, the installation process is essentially reversed. That is, a pulling force is applied to the second portion 35' of line 35, 35'. The pulling force pulls the connection member 20*a* towards and/or out of the socket 15*a* and/or along the guide portion 65 and/or away from the guide portion 65. Next, a reduction in the pulling force on a second portion 35' of the line, the pulling force being in a direction away from the guide 25*a*, coupled with a further pulling force applied to the connection member 20*a*, moves the connection member 20*a* out of the socket 15*a* and/or in a direction away from the socket 15*a*. The further pulling force is applied to the support line 80. The support line 80 comprises a bridle 85 to maintain the orientation of the connection member 20*a* during installation and/or removal.

Figure 8:
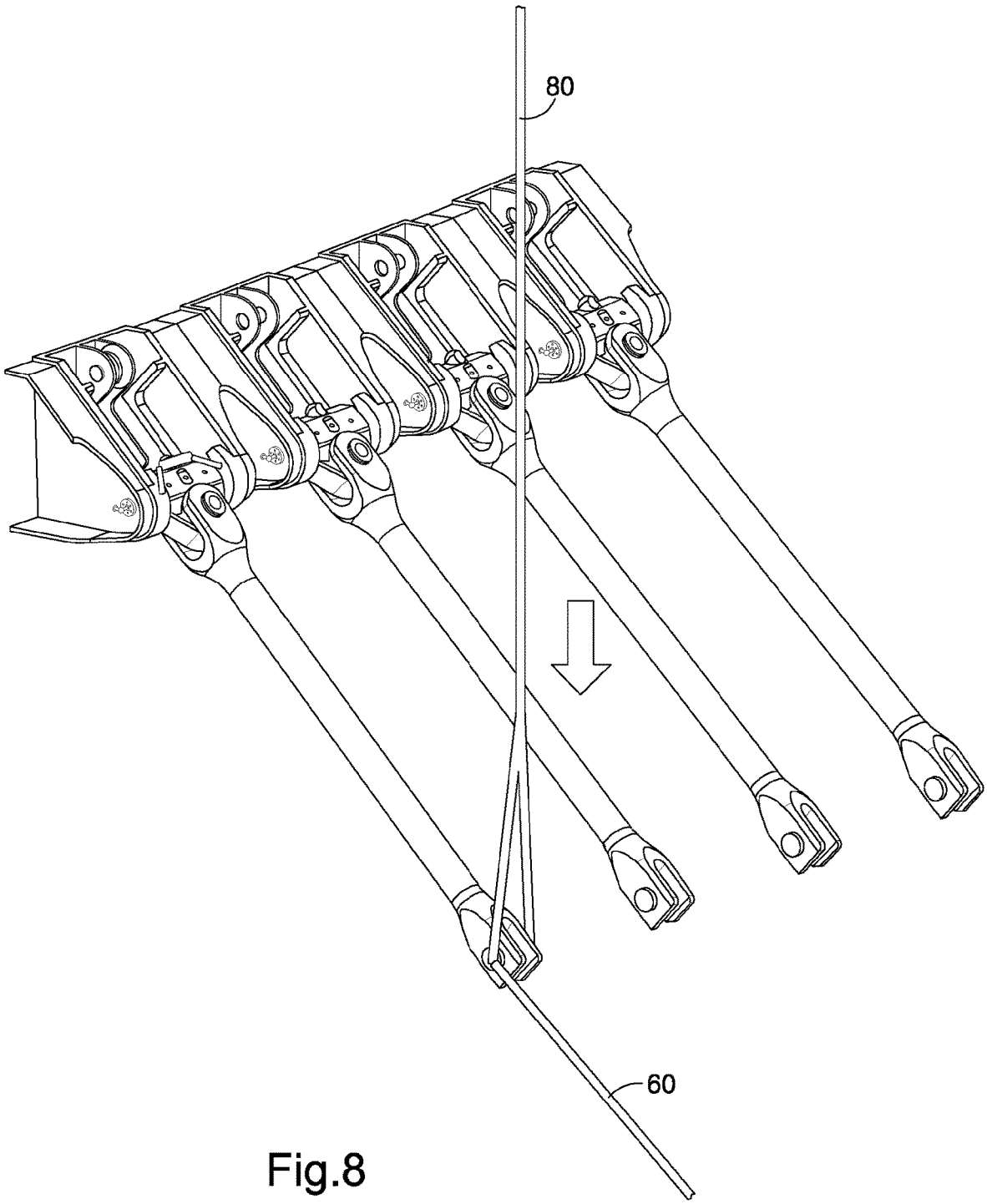
FIG. 8 a perspective view of the mooring system according to the first embodiment of the present invention.

FIG. 8 shows a perspective view of a mooring system 50, according to the first embodiment of the present invention. In FIG. 8, the connection member 20*a* has been lowered to a mooring angle. That is, the connection member 20*a* is aligned with the mooring line 60, such that a mooring tension is taken by the socket 15*a*, and in particular by the pair of seats 40*a*, 40*b*.

Figure 9:
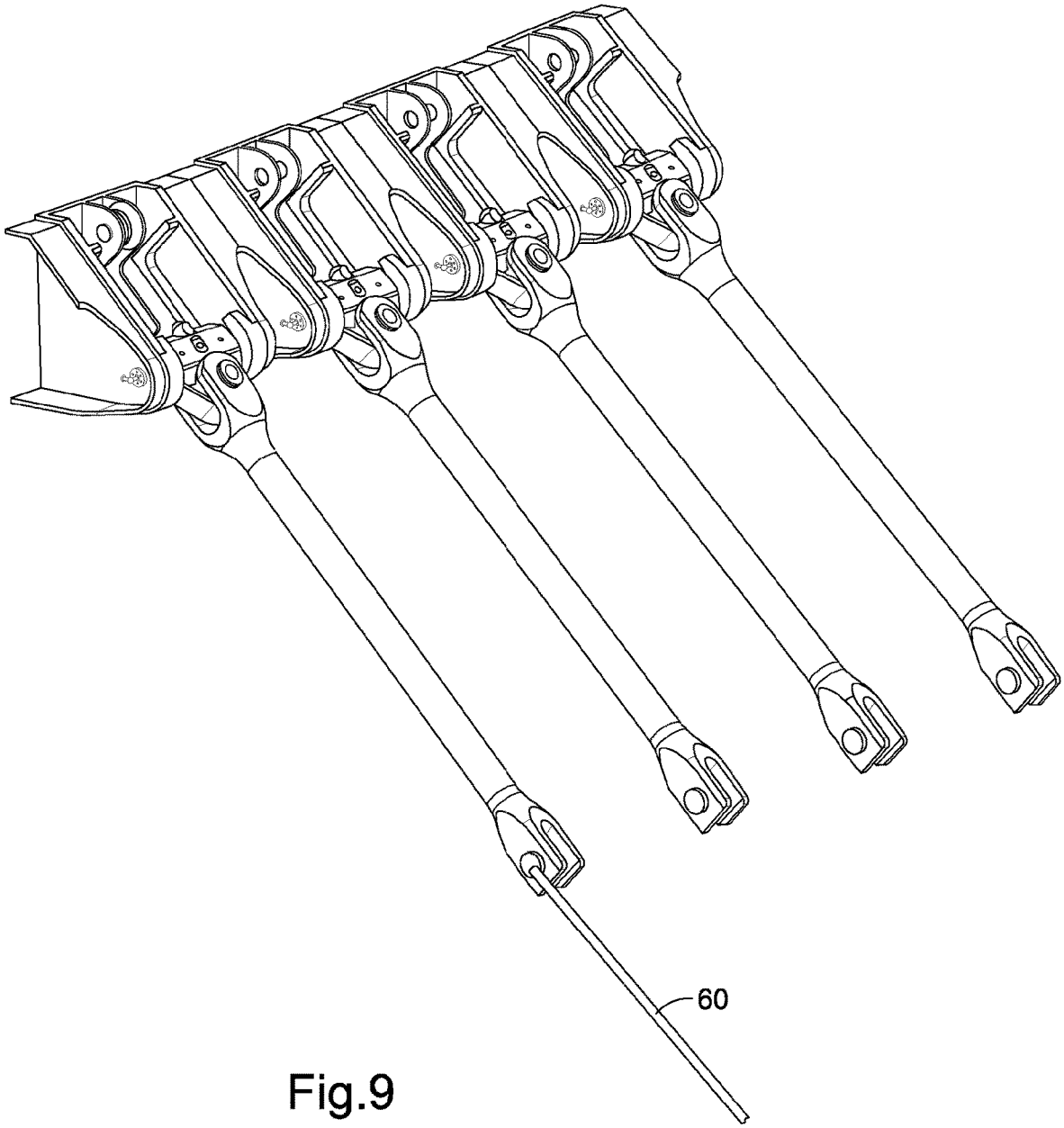
FIG. 9 a further perspective view of the mooring system according to the first embodiment of the present invention.

FIG. 9 shows a final stage in the installation process, wherein the support line 80 is removed.

Figure 10:
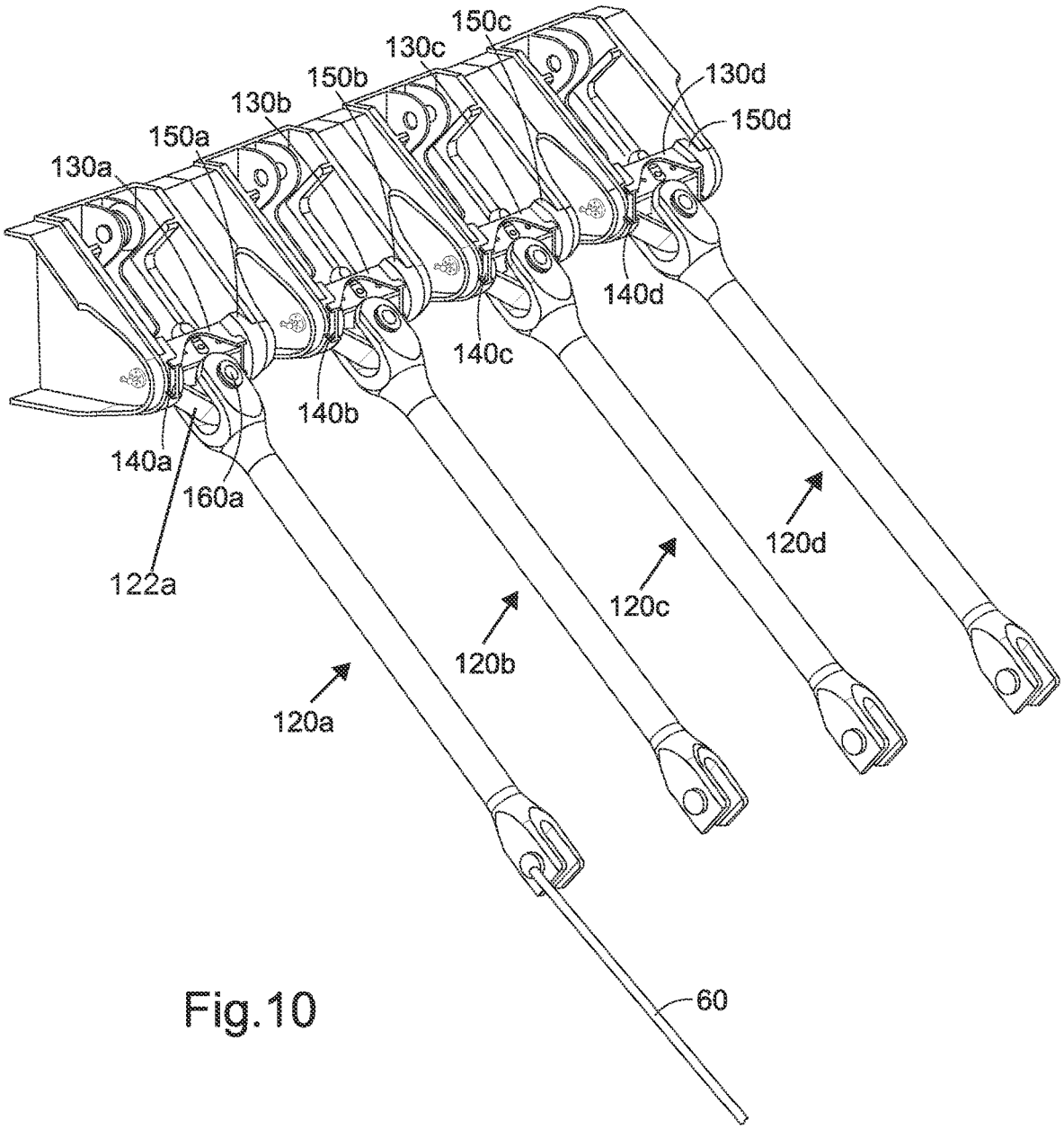
FIG. 10 a perspective view of a mooring system according to another embodiment of the present invention.

FIG. 10 shows a perspective view of a mooring system, according to another embodiment of the present invention. Each connection member 120*a*; 120*b*; 120*c*; 120*d* comprises a retaining member 130*a*; 130*b*; 130*c*; 130*d*.

Each retaining member 130*a*; 130*b*; 130*c*; 130*d* comprises a pair of shoulders or wings 140*a*; 140*b*; 140*c*; 140*d*. The pair of shoulders or wings 140*a*; 140*b*; 140*c*; 140*d* is adapted to move around and/or rotate around or about an outer surface of each pair of seats 150*a*; 150*b*; 150*c*; 150*d*. Each connection member 120*a*; 120*b*; 120*c*; 120*d* is adapted to be located in a retained position by each pair of shoulders or wings 140*a*; 140*b*; 140*c*; 140*d*. In the retained position, each pair of seats 150*a*; 150*b*; 150*c*; 150*d* is located between each pair of trunnions 90*a*, 90*b* and each pair of shoulders or wings 140*a*; 140*b*; 140*c*; 140*d*.

Figure 11:
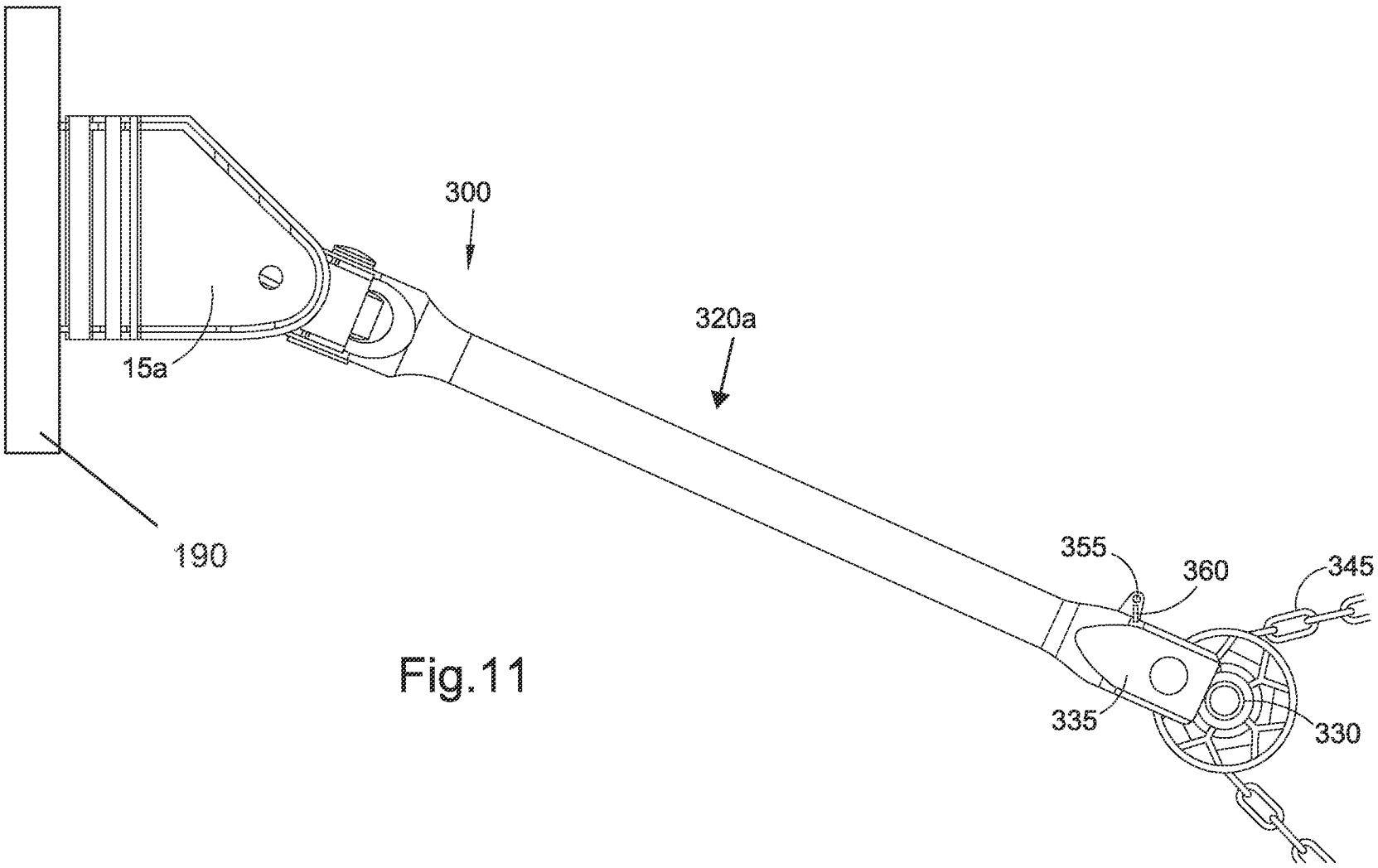
FIG. 11 a side view of a further embodiment of a mooring apparatus according to the present invention.

Referring now to FIG. 11, there is shown a further embodiment of a mooring apparatus, generally denoted 300. The mooring apparatus 300 comprises the same socket 15*a* as the socket of the embodiment shown in FIG. 1. In the exemplary embodiment shown in FIG. 11, there is a single mooring apparatus 300. One would appreciate that, in use, there may be more mooring apparatuses, such as two, three, four or even more mooring apparatuses, as shown, for example, in FIG. 1*a*.

The mooring apparatus 300 comprises a connection member 320*a*. The connection member 320*a* is receivable within socket 15*a*.

The connection member 320*a* comprises a tensioner apparatus 330. The tensioner apparatus 330 comprises a frame 335 and a guide portion 340 for guiding a portion of a chain 345. The guide portion 340 is a chain wheel. The tensioner apparatus 330 comprises a locking means 350. The locking means 350 is a chain stopper. The guide portion 340 is moveably connected to the frame 335. The locking means 350 is pivotably connected to the frame 335.

In an engaged position, as shown in FIG. 11, the locking means 350 restrains the guide portion 340 and/or the chain 345. The locking means 350 can be adapted to be locked in a disengaged position wherein the locking means 350 does not restrain the guide portion 340 and/or the chain 345. The tensioner apparatus 300 comprises a hole 355. A locking pin 360 can be inserted in the hole 355, such that the locking pin 360 engages with the locking means 350, thus retaining the locking means 350 in the disengaged position.

It will be appreciated that the embodiments of the present invention herebefore described are given by way of example only and are not meant to limit the scope of thereof. It will be appreciated that embodiments of the present invention provide benefits over the prior art.

In the embodiments of the present invention shown in FIGS. 1 to 10, the apparatus comprises a universal joint. That is, the apparatus shown is a "Dual Axis" device. Specifically, the connection member 20*a* is rotatable on the pair of trunnions 90*a*, 90*b*, about a first axis defined by the trunnions 90*a*, 90*b*. A portion 122*a* of the connection member 120*a* is also rotatable about a second axis, the second axis being substantially perpendicular to the first axis, the second axis being centered on joint 160*a*. It will be appreciated that in other embodiments encompassing the inventive concept of the present invention, the connection member may be a "Single Axis" device, and may not comprise joint 160*a*. Such an arrangement would, for example, be adapted for use on a structure 190, wherein the structure 190 has a rotatable portion, such as a turret mooring.

Advantageously, the apparatus, system and method described herein may permit the mooring line to be pre-cut to size and installed without a tensioning device on such, since the mooring line can be pulled in at a tension above the nominal/design tension of the mooring line to a "pulled in" position and then lowered down to the seat to achieve a design tension.

The invention claimed is:

1. A mooring apparatus comprising:

a connection member comprising a pair of trunnions arranged such that the connection member is rotatable about an axis defined by the pair of trunnions when the connection member is received in the socket, the socket, wherein the socket comprises a pair of substantially hook-shaped seats configured to receive the pair of trunnions and a guide portion for guiding the pair of trunnions during installation of the connection member in the socket, the guide portion extending to a limiting portion; and a positioning arrangement comprising a guide and configurable to install the connection member in the socket by a pulling force applied to a line connected to the connection member and extending around the guide, wherein the limiting portion is configured to stop the connection member interfering with the guide during installation of the connection member.

2. The mooring apparatus as claimed in claim 1, wherein the connection member is removably receivable in the socket.

3. The mooring apparatus as claimed in claim 1, wherein the connection member comprises a joint defining an axis about which at least a portion of the connection member is adapted to rotate.

4. The mooring apparatus as claimed in claim 1, wherein the positioning arrangement comprises a line engaging apparatus disposed on the connection member, wherein, in use, the line extends from the line engaging apparatus around the guide.

5. The mooring apparatus as claimed in claim 4, wherein in use, a pulling force on a second portion of the line, the pulling force being in a direction away from the guide, pulls a first portion of the line towards the guide.

6. The mooring apparatus as claimed in claim 5, wherein at least one of:

the pulling force pulls the connection member towards and/or into the socket and/or onto at least one guide portion;

a reduction in the pulling force on the second portion of the line can move or drop the connection member into the seat;

the pulling force pulls the connection member towards and/or out of the socket and/or towards or away from the pair of seats along a guide portion and/or away from a guide portion; and/or a reduction in the pulling force on a second portion of the line coupled with a further pulling force applied to the connection member, moves the connection member out of the socket and/or in a direction away from the socket.

7. The mooring apparatus as claimed in of claim 6, wherein the further pulling force is applied by a support line.

8. The mooring apparatus as claimed in claim 1, wherein:

the pair of seats at least partially or substantially face toward, or are oriented in the direction of, the guide.

9. The mooring apparatus as claimed in claim 1, wherein the connection member is configurable to connect the apparatus to a mooring line.

10. The mooring apparatus as claimed in claim 1, wherein a distal end of the connection member is adapted for connecting the apparatus to a mooring line.

11. The mooring apparatus as claimed in claim 1, wherein the connection member comprises a lever arm.

12. The mooring apparatus as claimed in claim 1, further comprising a retaining pin adapted to restrict movement of the connection member when the connection member is positioned on the pair of seats.

13. The mooring apparatus as claimed in claim 1, wherein the connection member comprises at least one retaining member, and wherein the connection member and/or the retaining member comprises at least one shoulder or wing.

14. The mooring apparatus as claimed in claim 13, wherein:

at least one shoulder or wing is adapted to move around and/or rotate around or about an outer surface of the pair of seats; and/or the connection member is adapted to be located in a retained position within and/or by the or each socket, wherein in the retained position, the pair of seats is located between the pair of trunnions and the at least one shoulder or wing.

15. The mooring apparatus as claimed in claim 1, wherein the apparatus is adapted for connection to, or mounting on or in any of: a floating structure, a vessel, an anchor, a turret mooring, or a pile.

16. The mooring apparatus as claimed in claim 1, wherein in use, during installation and/or stowage and/or removal, replacement or maintenance of the apparatus, the at least a portion of the connection member is at least partially submerged.

17. The mooring apparatus of claim 1, wherein the positioning arrangement comprises the line.

18. A mooring system, comprising:

a plurality of mooring apparatuses as claimed in claim 1;

a mooring line and/or a support line, wherein at least a portion of the mooring line and/or the support line comprises a chain; and any of: a floating structure, a vessel, an anchor, a turret mooring, or a pile.

19. A method of configuring a mooring apparatus, wherein the method comprises:

(a) providing the mooring apparatus comprising:

a socket comprising a pair of seats;

a connection member comprising a pair of trunnions arranged such that the connection member is rotatable about an axis defined by the pair of trunnions when the connection member is received in the socket; and a positioning arrangement comprising a guide;

(b) connecting a first line to a first end of the connection member and connecting a second line to a second end of the connection member and extending the second line around the guide; and (c) installing the connection member in the socket by applying pulling forces to the first and second lines to position the connection member relative to the pair of seats and to seat the pair of trunnions on the pair of seats.

20. The method of claim 19, wherein seating the pair of trunnions on the pair of seats comprises applying a pulling force followed by a reduction in the pulling force to the line in a direction away from the guide.

21. The method of claim 19, wherein a mooring line is connected to the connection member when the pair of trunnions is seated on the pair of seats.

22. A mooring system comprising:

a first line;

a second line; and a mooring apparatus comprising:

a socket comprising a pair of seats, a connection member comprising a pair of trunnions arranged such that the connection member is rotatable about an axis defined by the pair of trunnions when the connection member is received in the socket; and a positioning arrangement comprising a guide;

wherein the pair of trunnions is configured to be seated on the pair of seats by:

a pulling force applied to the first line connected to a first end of the connection member for positioning the connection member relative to the pair of seats; and a pulling force applied to the second line extending around the guide and connected to a second end of the connection member.

23. The mooring system of claim 22, wherein:

the first end of the connection member is a distal end of the connection member relative to the guide; and the second end of the connection member is a proximal end of the connection member relative to the guide.

* * * * *